United States Patent [19]

Gizzi

[11] Patent Number: 5,035,387

[45] Date of Patent: Jul. 30, 1991

[54] PAINTBRUSH HOLDER AND SCRAPER

[76] Inventor: Eugene A. Gizzi, 2701 SW. 13th Ave., Fort Lauderdale, Fla. 33315

[21] Appl. No.: 568,788

[22] Filed: Aug. 17, 1990

[51] Int. Cl.[5] ..... A46B 17/02

[52] U.S. Cl. ..... 248/110; 248/213.2

[58] Field of Search ..... 248/213.2, 110, 111, 248/112, 113, 309.2; 211/65, 66, 59.1; 220/90

[56] References Cited

U.S. PATENT DOCUMENTS

| | | | |
|---|---|---|---|
| 2,325,595 | 8/1943 | Dieke | 248/113 |
| 2,487,516 | 11/1949 | Braswell | 248/110 |
| 2,533,354 | 12/1950 | Comfort | 211/65 |
| 2,674,391 | 4/1954 | Davis | 248/113 X |
| 4,266,686 | 5/1981 | Carter | 220/90 |
| 4,266,746 | 5/1981 | Klaiber | 248/113 |
| 4,275,818 | 6/1981 | Church | 220/90 |
| 4,485,929 | 12/1984 | Betts | 248/222.4 |
| 4,832,293 | 5/1989 | Gizzi | 248/110 |
| 4,844,281 | 7/1989 | Bradford | 220/90 |

*Primary Examiner*—J. Franklin Foss
*Attorney, Agent, or Firm*—Alvin S. Blum

[57] ABSTRACT

A paintbrush holder and scraper fits onto the rim of an open paint can. A vartical member extends up from the rim and supports a projecting pin for engaging the hole in a paintbrush handle. When held by the pin, the paintbrush rests with the bristles draining into the can and resting against teh scraper. The scraper has a flat edge that also drains into the can for wiping excess paint off the bristles. The vertical member is removably joined to a rim cover member that covers the rim of the can to prevent paint from contaminating the rim. A snap lock arrangement secures the cover member to the rim of the can. The scraper is integral with the rim cover. A single vertical member may be used with many cover members of different sizes.

6 Claims, 2 Drawing Sheets

PAINTBRUSH HOLDER AND SCRAPER

FIELD OF THE INVENTION

This invention relates to painting accessories and more particularly to a device which attaches to the rim of a paint can that will hold the brush an provide and edge for scraping excess paint off the bristles while preventing paint from entering the can cover groove.

BACKGROUND OF THE INVENTION

Applicant's U.S. Pat. No. 4,832,293 provides a device that snaps onto the bail of a paint can to provide a brush holder and scraper with a convenient handle for carrying the brush and can. The rim of the paint can is not protected from paint. If paints gets into the cover groove it is difficult to avoid spillage and the paint tends to cement the lid in place when it dries. This device in not useful for cans without bails.

Bradford in U.S. Pat. No. 4,844,281 teaches a shell that covers the rim of a paint can and provides a shelf for resting the bristles and a dove-tail land for engaging the handle. The bristles tend to distort when resting on the shelf and paint dries on the shelf.

SUMMARY OF THE INVENTION

It is accordingly an object of the invention to provide a device that will snap onto a paint can, protect the cover groove, hold a paint brush by the handle with the bristles draining directly into the can and also provide a scraping edge for removing excess paint from the bristles. It is another object that the device operate in the absence of a bail. It is yet another object that the device be useable with cans of different sizes.

The device of the invention includes an upright member that carries a pin that engages the hole ordinarily drilled through the handle of a paint bursh. A second member comprises a circular, horizontal rim-covering member that has an engaging means for removably engaging the upright member such that the bristles of the brush hanging from the pin drain directly into the paint can when the horizontal member is snapped in place over the rim of the paint can. The horizontal member also includes a paint scraper that drains into the paint can.

These and other objects, features and advantages of the invention will become more apparent when the detailed description is read in conjunction with the drawings.

DETAILED DESCRIPTION OF THE PREFERRED EMBODIMENT

Figure 3:
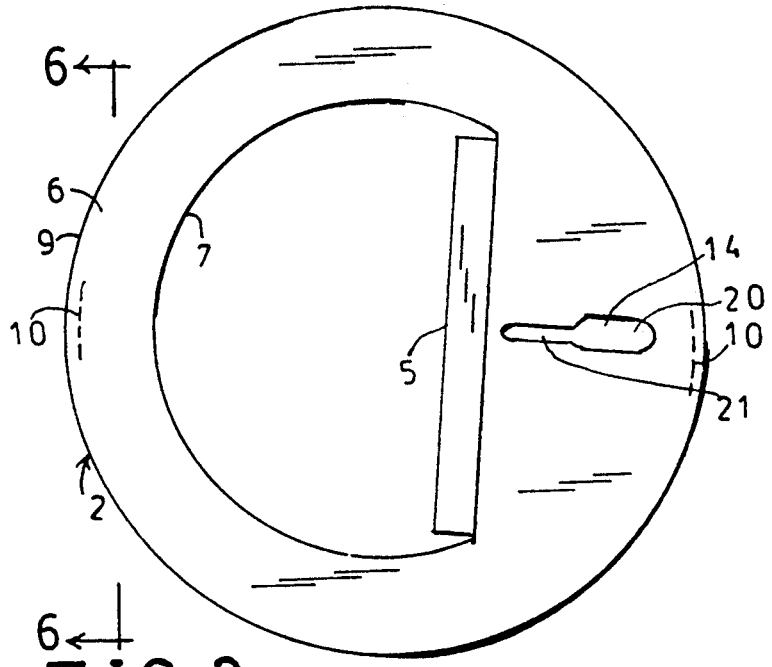
FIG. 3 is a top view of the rim cover member.
Figure 1:
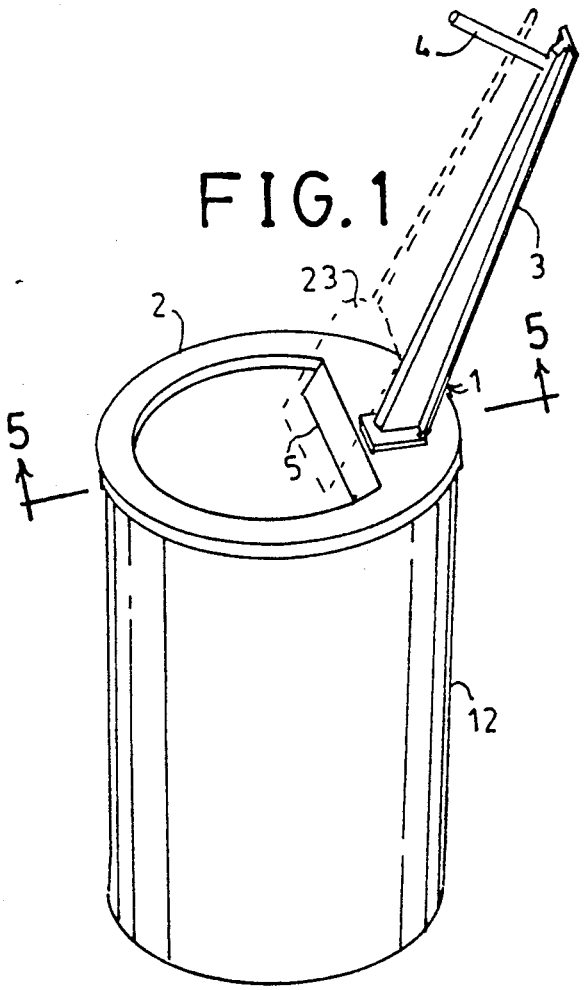
FIG. 1 is a perspective view of the invention in use on a paint can.
Figure 2:
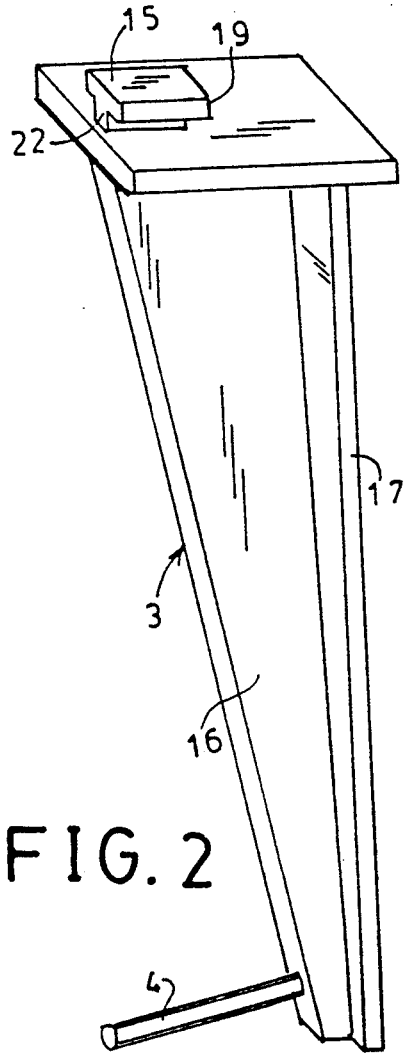
FIG. 2 is an inverted perspective view of the hanger member.
Figure 4:
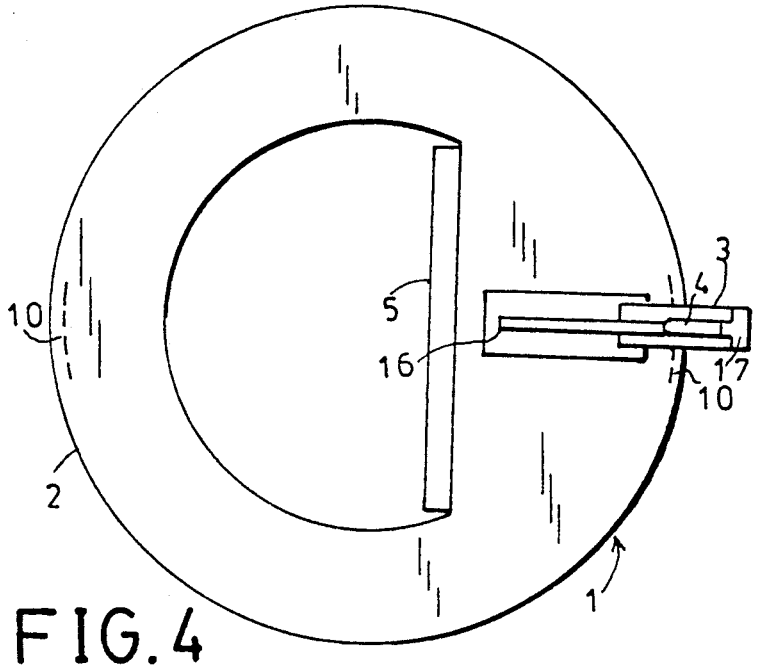
FIG. 4 is a top view of the device of FIG. 1.
Figure 5:
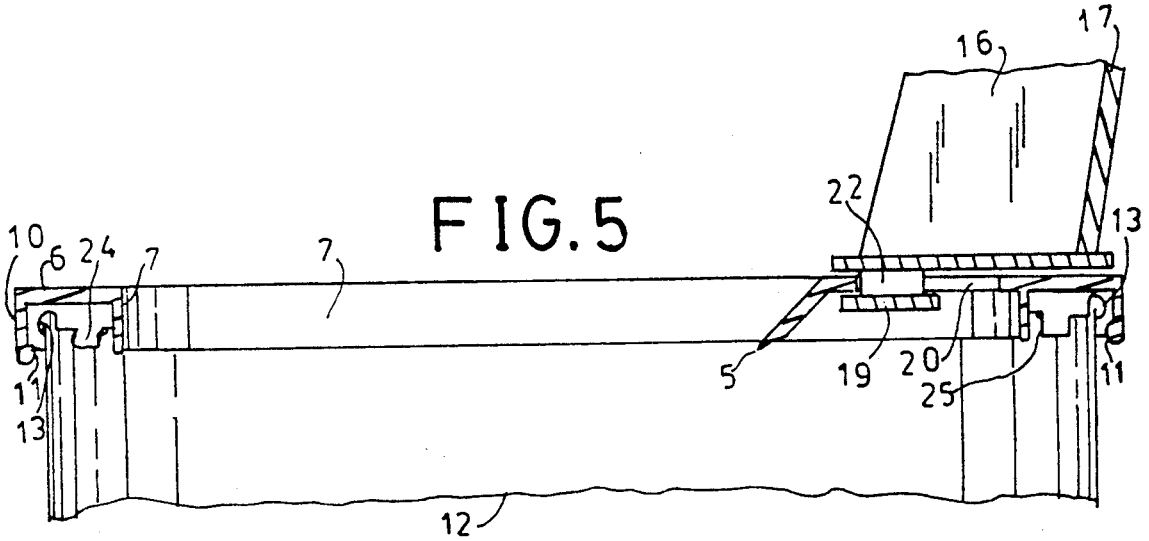
FIG. 5 is a partial sectional view taken on line 5—5 of FIG. 1.
Figure 6:
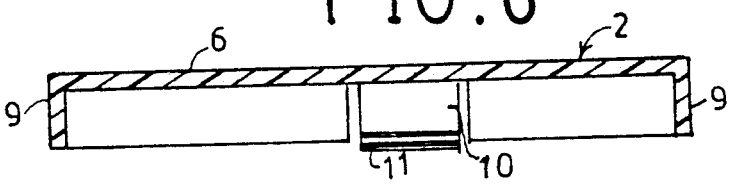
FIG. 6 is a sectional view taken on line 6—6 of FIG. 3.

Referring now first to FIG. 1, an open can of paint 12 is provided with a cover over the rim and with a holder for the brush 23 (shown in phantom) by snapping the brushholder and scraper 1 over the rim of the can. The brush is held by pin 4 passing through the hole in the handle. The bristles of the brush extend into the can and lie against the scrapper 5 so that any paint drains directly into the can. When the brush is in use, the flat scraper 5 is much more useful for removing excess paint than the curved rim of the can, and the excess paint drains directly into the can from the edge of the scraper.

As best seen in FIGS. 2–5, the invention is made up of two members which removably join together, the rim cover member 2 and the hanger member 3. The base of the hanger member 3 has a locking key 15 that locks into keyhole 14 in the rim cover member 2. A pin 4 is supported by vertical element 16 with stiffening rib 17 on hanger member 3 for conveniently holding the paintbrush when not in use. This pin 4 is small enough to pass through the hole generally found in the handle of paintbrushes so that they may be used without modification.

The rim cover member 2 has a top 6, an outer flange 9 that completely encircles the rim of the can and an inner flange 7 that fits within the inner diameter of the can rim so that paint is effectively kept from the groove 24 in the can rim 25. To secure the cover member to the can, cover member 2 is provided with flexible locking elements 10 that bend outwardly over the rolled edge 13 of the can rim and then snap into place with bead 11 beneath the rolled edge of the can rim. Various means well known in the art may be employed for removably connecting the hanger member 3 to the rim cover member 2. The preferred means shown involves a key 15 and keyhole 14. The key is of the T-element type with a flange 19 and a web 22. The keyhole 14 has an enlarged portion 20 to admit the flange 19 and a reduced portion 21 that fits snugly to the web 22 when the member 3 is moved outwardly in the keyhole.

The single hanger member may be used with multiple cover members of different sizes so that considerable economy in manufacturing and inventory costs may be realized. The disassembled device is less costly to package, ship and store.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A paintbrush holder and scraper for removably engaging and completely covering the entire rim of a paint can comprising:

(a) an elongate holder member having a connecting means for removably engaging a rim cover member at a first end and a holder pin at a second end, said holder pin supported above said can and adapted for engagement with a hole in the handle of said paintbrush, wherein said paintbrush will drain into said can when so engaged;

(b) a rim cover member bearing a flat paintbrush scraper or wiper element so arranged to wipe excess paint off said paintbrush and to drain paint into said can, said rim cover member having a plurality of rim locking means for removably engaging the rim of said paint can, said rim cover member having an outer portion defining a complete circle for covering said rim in its entirety when so engaged to thereby prevent paint from contaminating said rim when in use, and said rim cover member provided with engaging means for removably engaging said connecting means to support said holder member at a fixed angle above said rim, said scraper element being completely encircled by said outer portion and arranged for engaging a lateral portion of said paintbrush when said holder pin engages said handle of said paintbrush.

2. The paintbrush holder and scraper according to claim 1, in which said connecting means includes a key member and said engaging means includes a keyhole.

3. The paintbrush holder and scraper according to claim 1, in which said rim locking means includes a flexible tab with a bead arranged for said bead to snap into place below the rolled edge of said rim.

4. The paintbrush holder and scraper according to claim 1, in which said rim cover member includes a substantially flat top portion, an inner flange extending down from said top and an outer flange extending down from said top wherein said inner flange fits within the inside diameter of said rim and said outer flange fits outside the outer diameter of said rim.

5. The paintbrush holder and scraper according to claim 4, in which said rim locking means includes a flexible tab portion cut from said outer flange, said flexible tab portion having a bead arranged for snapping into place below the rolled edge of said rim.

6. The paintbrush holder and scraper according to claim 1, in which a plurality of said rim cover members are provided of different diameters for use with paint cans of different diameters with a single one said holder member.

* * * * *